US010790591B2

(12) United States Patent
Rowell et al.

(10) Patent No.: US 10,790,591 B2
(45) Date of Patent: Sep. 29, 2020

(54) INTEGRATED DEVICE AND MANUFACTURING METHOD THEREOF

(71) Applicant: Rohde & Schwarz GmbH & Co. KG, Munich (DE)

(72) Inventors: Corbett Rowell, Munich (DE); Daniel Markert, Deggendorf (DE); Christian Riedel, Grafing (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 49 days.

(21) Appl. No.: 16/159,256

(22) Filed: Oct. 12, 2018

(65) Prior Publication Data

US 2020/0021033 A1 Jan. 16, 2020

(30) Foreign Application Priority Data

Jul. 10, 2018 (EP) ..... 18182598

(51) Int. Cl.
*H01Q 13/02* (2006.01)

(52) U.S. Cl.
CPC ..... *H01Q 13/0258* (2013.01); *H01Q 13/0225* (2013.01); *H01Q 13/0241* (2013.01); *H01Q 13/0283* (2013.01)

(58) Field of Classification Search
CPC ..... H01Q 13/0258; H01Q 13/0225; H01Q 13/0241; H01Q 13/0283
USPC ..... 333/137
See application file for complete search history.

(56) References Cited

U.S. PATENT DOCUMENTS 5,784,033 A * 7/1998 Boldissar, Jr. ..... H01P 1/2131 333/113
2004/0160292 A1* 8/2004 Chen ..... H01P 1/161 333/125
2010/0141543 A1* 6/2010 Parekh ..... H01P 1/161 343/786
2011/0037534 A1* 2/2011 Espino ..... H01P 1/161 333/127

FOREIGN PATENT DOCUMENTS

KR 1020150069792 6/2015

* cited by examiner

*Primary Examiner* — Robert J Pascal
*Assistant Examiner* — Kimberly E Glenn
(74) *Attorney, Agent, or Firm* — Potomac Technology Law, LLC

(57) ABSTRACT

An integrated device comprises a horn antenna with an antenna waveguide feed, a waveguide transition element comprising a first end connected to the antenna waveguide feed and second end, and an orthomode transducer comprising a common waveguide connected to the second end of the waveguide transition element and at least two separate waveguides. The orthomode transducer is adapted to couple at least two orthogonal linear polarized fields into the common waveguide of the orthomode transducer with the aid of the at least two separate waveguides of the orthomode transducer and/or vice versa. The horn antenna is preferably adapted to support at least two waveguide modes corresponding to the at least two orthogonal linear polarized fields. The integrated device is preferably manufactured in at least two separate blocks such that each part of the at least two piece assembly is constructed as external protrusions and/or holes and/or partial holes.

13 Claims, 8 Drawing Sheets

INTEGRATED DEVICE AND MANUFACTURING METHOD THEREOF

RELATED APPLICATIONS

This application claims priority from European Patent Application No. EP18182598.5 (filed 2018 Jul. 10), the entirety of which is incorporated by reference herein.

TECHNICAL FIELD

The invention relates to an integrated device, especially comprising a horn antenna, a waveguide transition element, and an orthomode transducer, and a corresponding manufacturing method thereof.

BACKGROUND

Generally, in times of an increasing number of applications providing wireless communication capabilities, there is a growing need of a cost-efficient integrated device and a corresponding manufacturing method thereof for efficiently transmitting and/or receiving signals with respect to said applications in order to verify a proper functioning thereof.

The publication KR1020150069792A discloses a jig device for measuring the performance of a polarizer and, more specifically, a jig capable of measuring the performance of a polarizer changing a phase. Furthermore, the jig measures the performance of a polarizer outputting polarization, inputted through an input terminal of the polarizer, through an output terminal of the polarizer by changing the polarization into circular polarization. The jig includes an input terminal measuring jig receiving linear polarization having an inclined angle to spread the polarization to the input terminal of the polarizer, and an output terminal measuring jig separating the circular polarization, delivered from the output terminal, into horizontal polarization and vertical polarization to output the polarization to different output ports. However, due to the fact that said jig consists of many separate parts, its manufacturing is complex and expensive.

Accordingly, there is a need to provide a cost-efficient integrated device and a corresponding manufacturing method thereof.

SOME EXAMPLE EMBODIMENTS

Embodiments of the present invention advantageously address the foregoing requirements and needs, as well as others, by providing a cost-efficient integrated device and a corresponding manufacturing method thereof.

According to a first aspect of the invention, an integrated device is provided. The integrated device comprises a horn antenna with an antenna waveguide feed, a waveguide transition element comprising a first end connected to the antenna waveguide feed and a second end, and an orthomode transducer comprising a common waveguide connected to the second end of the waveguide transition element and at least two separate waveguides. In this context, the orthomode transducer is adapted to couple at least two orthogonal linear polarized fields into the common waveguide of the orthomode transducer with the aid of the at least two separate waveguides of the orthomode transducer and/or vice versa.

In addition to this, the horn antenna is preferably adapted to support at least two waveguide modes corresponding to the at least two orthogonal linear polarized fields. Furthermore, the integrated device is preferably manufactured in at least two separate blocks such that each part of the at least two piece assembly is constructed as external protrusions and/or holes and/or partial holes. Advantageously, in this manner, a reduced complexity and a high cost-efficiency can be ensured.

According to a further preferred implementation form of the first aspect of the invention, the antenna waveguide feed is an elliptical antenna waveguide feed, preferably a circular antenna waveguide feed. Advantageously, for instance, complexity can further be reduced.

According to a further preferred implementation form of the first aspect of the invention, the first end of the waveguide transition element is of elliptical shape, preferably of circular shape. Advantageously, for example, complexity can further be reduced.

According to a further preferred implementation form of the first aspect of the invention, the second end of the waveguide transition element is of rectangular shape, preferably of square shape. Advantageously, for instance, complexity can further be reduced, thereby especially increasing cost-efficiency.

According to a further preferred implementation form of the first aspect of the invention, the common waveguide of the orthomode transducer is of rectangular shape, preferably of square shape. Advantageously, for example, cost-efficiency can further be increased especially by reducing complexity.

According to a further preferred implementation form of the first aspect of the invention, at least one of the at least two separate waveguides of the orthomode transducer is of rectangular shape. Advantageously, for instance, a further reduced complexity can be ensured. According to a further preferred implementation form of the first aspect of the invention, alignment pins and threaded holes are provided on the at least two piece assembly to facilitate the assembly. Advantageously, in this manner, an accurate and efficient assembly can be guaranteed.

According to a further preferred implementation form of the first aspect of the invention, the integrated device further comprises at least one waveguide to coax interface, preferably at least one rectangular waveguide to coax interface. In this context, the at least one waveguide to coax interface, preferably the at least one rectangular waveguide to coax interface, is connected to at least one of the at least two separate waveguides of the orthomode transducer. Advantageously, a coaxial transmission line or a coaxial cable can efficiently be connected.

According to a further preferred implementation form of the first aspect of the invention, the at least one waveguide to coax interface, preferably the at least one rectangular waveguide to coax interface, is constructed as a separate and/or detachable part. Advantageously, for instance, complexity can further be reduced.

According to a further preferred implementation form of the first aspect of the invention, the integrated device comprises at least one screw connection for connecting the at least two separate blocks. Advantageously, assembling can be performed in a cost-efficient manner.

According to a further preferred implementation form of the first aspect of the invention, at least one of the at least two separate blocks comprises metal, preferably metal comprising a gold plating, more preferably aluminum, most preferably aluminum comprising a gold plating, and/or graphene, preferably a graphene plating. Advantageously, waveguide modes can be guided with a high quality.

According to a further preferred implementation form of the first aspect of the invention, the integrated device is manufactured in three separate blocks such that each part of the three piece assembly is constructed as external protrusions and/or partial holes. In this context, the external protrusions and/or partial holes are milled without forming enclosed internal cavities and/or holes. Advantageously, especially due to an easy milling process, cost-efficiency can further be increased.

According to a second aspect of the invention, a manufacturing method for manufacturing an integrated device comprising a horn antenna, a waveguide transition element, and an orthomode transducer is provided. The manufacturing method comprises the steps of manufacturing the integrated device in at least two separate blocks, and constructing each part of the at least two piece assembly as external protrusions and/or holes and/or partial holes. Advantageously, in this manner, a reduced complexity and a high cost-efficiency can be ensured.

According to a first preferred implementation form of the second aspect of the invention, the manufacturing method further comprises the step of providing alignment pins and threaded holes on the at least two piece assembly to facilitate the assembly. Advantageously, in this manner, an accurate and efficient assembly can be guaranteed.

According to a further preferred implementation form of the second aspect of the invention, the manufacturing method further comprises the steps of manufacturing the integrated device in three separate blocks, constructing each part of the three piece assembly as external protrusions and/or partial holes, and milling the external protrusions and/or partial holes without forming enclosed internal cavities and/or holes. Advantageously, especially due to an easy milling process, cost-efficiency can further be increased.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various obvious respects, all without departing from the spirit and scope of the present invention. Accordingly, the drawing and description are to be regarded as illustrative in nature, and not as restrictive.

BRIEF DESCRIPTION OF THE DRAWINGS

Exemplary embodiments of the invention are now further explained with respect to the drawings by way of example only, and not for limitation. In the drawings.

DETAILED DESCRIPTION

A cost-efficient integrated device and a corresponding manufacturing method thereof, are described. In the following description, for the purposes of explanation, numerous specific details are set forth in order to provide a thorough understanding of the invention. It is apparent, however, that the invention may be practiced without these specific details or with an equivalent arrangement. In other instances, well-known structures and devices are shown in block diagram form in order to avoid unnecessarily obscuring the invention.

Figure 1:
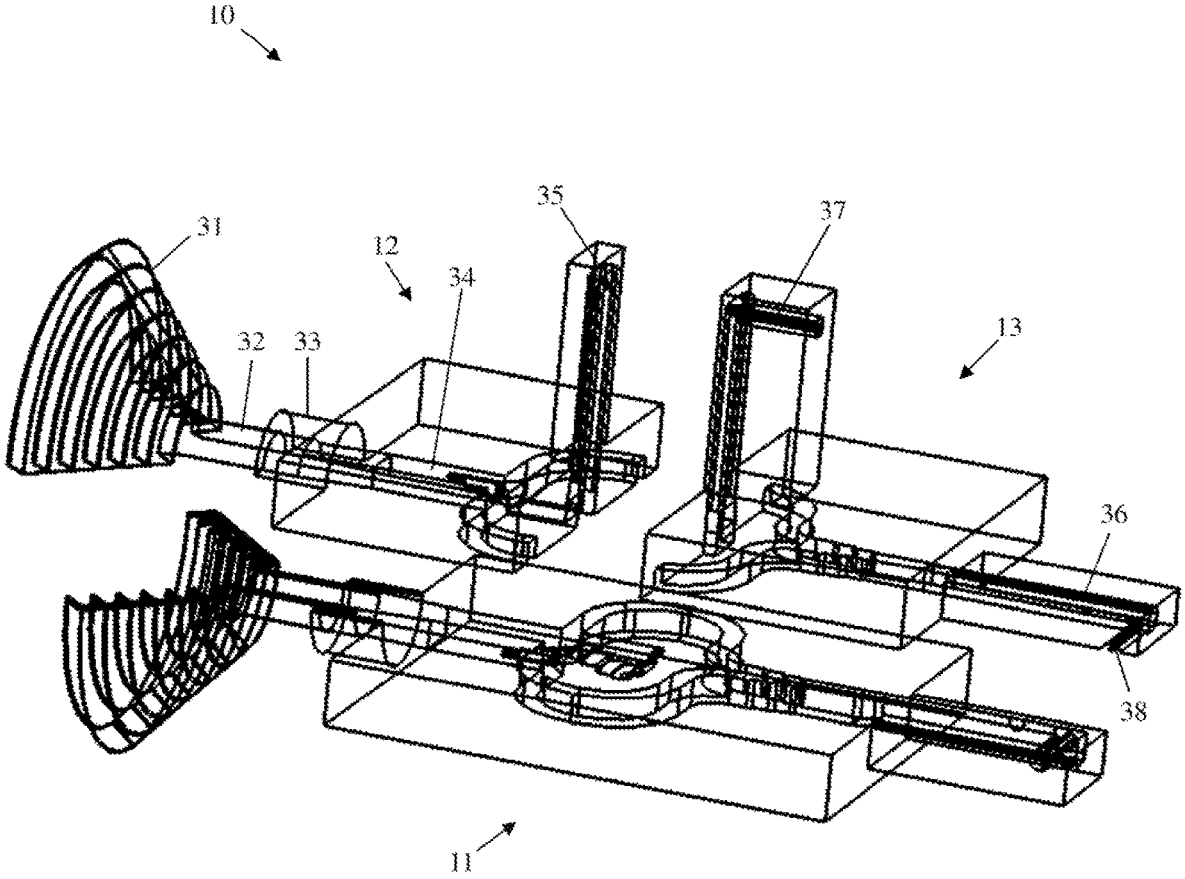
FIG. 1 shows a first exemplary embodiment of the first aspect of the invention based on a three piece assembly.

Firstly, FIG. 1 illustrates a first exemplary embodiment of an inventive integrated device 10. The integrated device 10 comprises a horn antenna 31 with an antenna waveguide feed 32, a waveguide transition element 33 comprising a first end connected to the antenna waveguide feed and a second end, and an orthomode transducer comprising a common waveguide 34 connected to the second end of the waveguide transition element and two separate waveguides, especially a first separate waveguide 35 and a second separate waveguide 36.

In this context, the orthomode transducer is adapted to couple at least two orthogonal linear polarized fields into the common waveguide 34 of the orthomode transducer with the aid of the two separate waveguides 35, 36 of the orthomode transducer and/or vice versa, wherein the horn antenna 31 is adapted to support at least two waveguide modes corresponding to the at least two orthogonal linear polarized fields.

As it can further be seen from FIG. 1, the integrated device or integrated part 10 is manufactured in three separate blocks 11, 12, 13 such that each part of the three piece assembly is constructed as external protrusions and/or partial holes, wherein the external protrusions and/or partial holes are especially milled without forming enclosed internal cavities and/or holes.

Furthermore, it is noted that the antenna waveguide feed 32 is a circular antenna waveguide feed, whereas the common waveguide 34 of the orthomode transducer is of square shape.

As a consequence of this, the first end of the waveguide transition element 33 is of circular shape, whereas the second end of the waveguide transition element 33 is of square shape. In other words, in this exemplary case, the wave guide transition element 33 is a circular to square waveguide transition element.

Moreover, according to FIG. 1, each of the two separate waveguides 35, 36 of the orthomode transducer is of rectangular shape.

It is noted that it might be particularly advantageous if alignment pins and threaded holes are provided on the three piece assembly 10 in order to facilitate the assembly.

Whereas said alignment pins and threaded holes are not explicitly shown in FIG. 1, FIG. 1 depicts that the integrated device 10 further comprises two waveguide to coax interfaces, preferably two rectangular waveguide to coax interfaces, especially a first rectangular waveguide to coax interface 37 and a second rectangular waveguide to coax interface 38.

In this context, each of the two rectangular waveguide to coax interfaces 37, 38 is connected to the respective one of the two separate waveguides 35, 36 of the orthomode transducer.

Preferably, each of the two rectangular waveguide to coax interfaces 37, 38 may be constructed as a separate and/or detachable part.

Furthermore, it is noted that the integrated device or part 10 may preferably comprise at least one screw connection for connecting the three separate blocks 11, 12, 13.

It is further noted that at least one of the three separate blocks 11, 12, 13 may especially comprise metal, preferably metal comprising a gold plating, more preferably aluminum, most preferably aluminum comprising a gold plating, and/or graphene, preferably a graphene plating.

Figure 2:
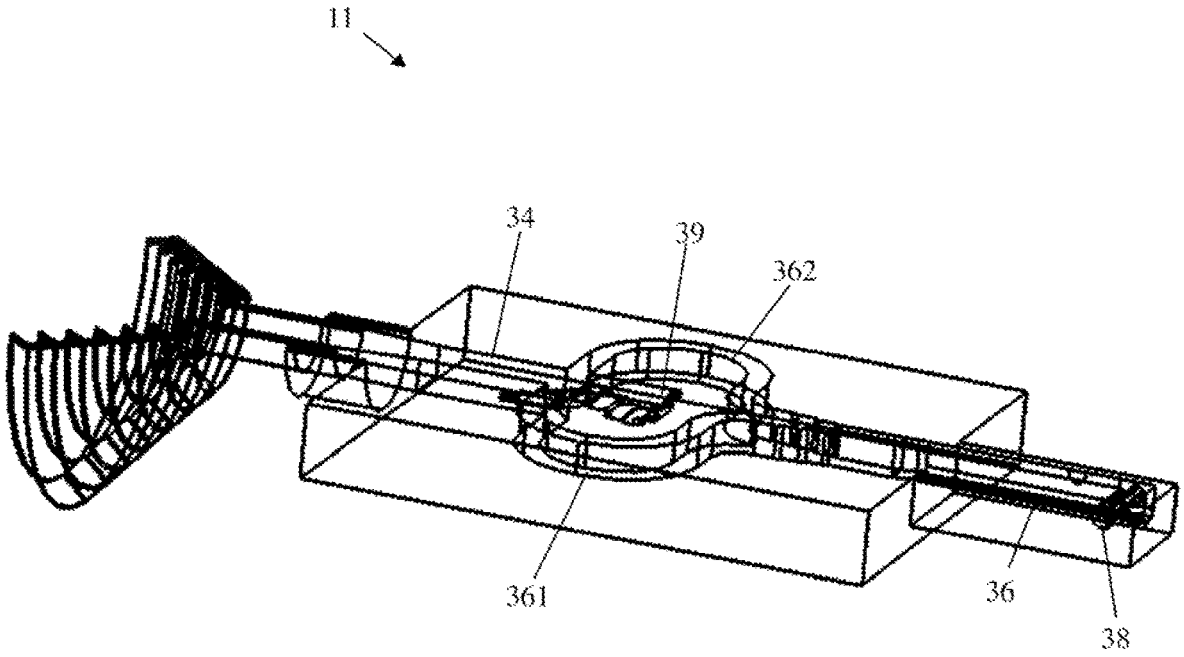
FIG. 2 shows the bottom part of the first exemplary embodiment.

Moreover, FIG. 2 illustrates the bottom part 11 of the first exemplary embodiment according to FIG. 1. As it can be seen, before the waves guided by the first separate waveguide 35 and the second separate waveguide 36 enter the common waveguide 34 of the orthomode transducer, the second separate waveguide 36 is divided into two partial waveguides, especially a first partial waveguide 361 and a second partial waveguide 362.

In this context, it is noted that the respective pathways of the first partial waveguide 361 and the second partial waveguide 362 are symmetric with respect to an axis, especially a longitudinal axis, of the second separate waveguide 36. It might be particularly advantageous if said axis, especially said longitudinal axis, runs through the center of the second separate waveguide 36.

Furthermore, it might be particularly advantageous if at least one, exemplarily each, of the partial waveguides 361, 362 is of a curved shape, a parabolic shape, or an U-shape.

With special respect to the orthomode transducer comprising the common waveguide 34, the first separate waveguide 35, and the second separate waveguide 36, it is noted that the common waveguide 34 and the second separate waveguide 36 are especially comprised, preferably intersected or touched, by the same plane. In addition to this, the first separate waveguide 35 is preferably perpendicularly arranged with respect to the common waveguide 34 and/or the second separate waveguide 36.

Moreover, in accordance with FIG. 2, the region 39, especially being located near the common waveguide 34 and in which the first separate waveguide 35 is arranged, is beveled. Preferably, the respective surface rises with decreasing distance from the common waveguide 34 or from the horn antenna 31, respectively. In addition to this or as an alternative, especially within the common waveguide 34 or within an entry area of the common waveguide 34, the respective surface falls with decreasing distance from the horn antenna 31.

Furthermore, with respect to the bottom part 11 illustrated by FIG. 2, it is noted that said exemplary bottom part 11 comprises a part of the horn antenna 31, a part of the antenna waveguide feed 32, a part of the waveguide transition element 33, a part of the common waveguide 34, a part of the first partial waveguide 361, a part of the second partial waveguide 362, a part of the second separate waveguide 36, and a part of the second rectangular waveguide to coax interface 38.

Figure 3:
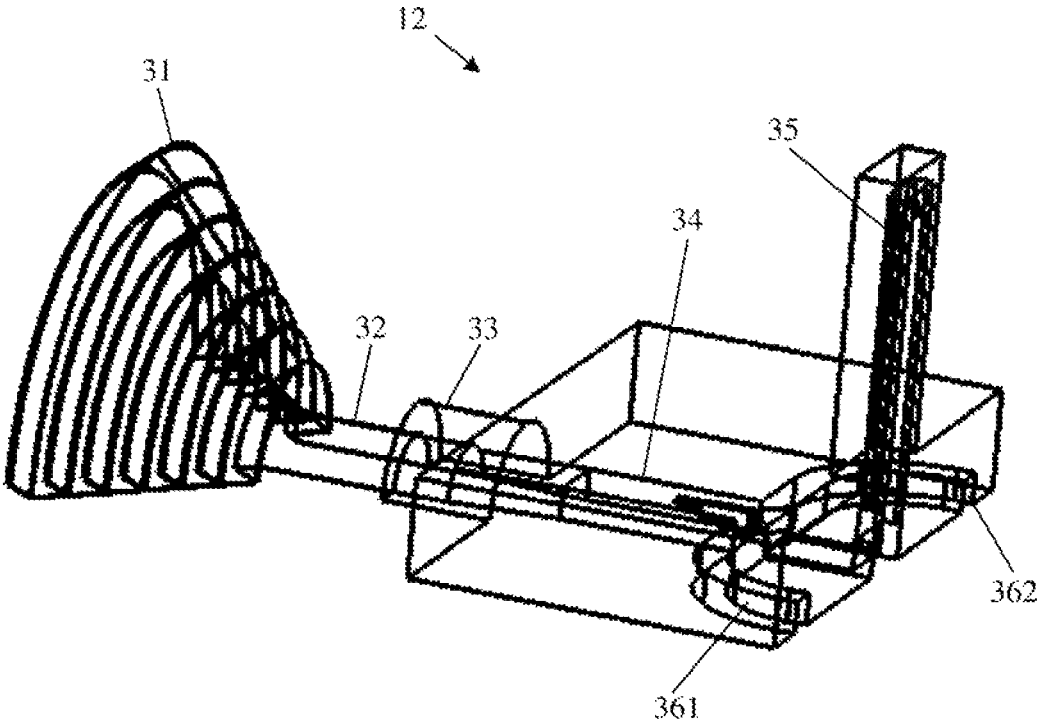
FIG. 3 shows the first top part of the first exemplary embodiment.

In addition to this, as shown in FIG. 3, the first top part 12 of the first embodiment 10 comprises a part of the horn antenna 31, a part of the antenna waveguide feed 32, a part of the waveguide transition element 33, a part of the common waveguide 34, a part of the first partial waveguide 361, a part of the second partial waveguide 362, and a part of the first separate waveguide 35.

Figure 4:
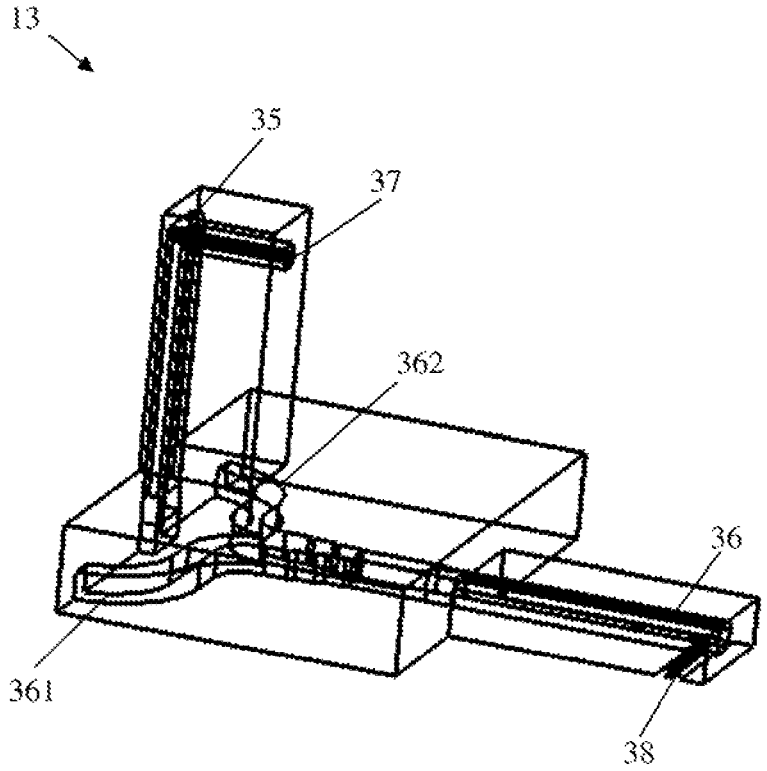
FIG. 4 shows the second top part of the first exemplary embodiment.

Further additionally, in accordance with FIG. 4, the second top part 13 of the first embodiment 10 comprises a part of the first partial waveguide 361, a part of the second partial waveguide 362, a part of the first separate waveguide 35, a part of the second separate waveguide 36, the first rectangular waveguide to coax interface 37, and a part of the second rectangular waveguide to coax interface 38.

Figure 5:
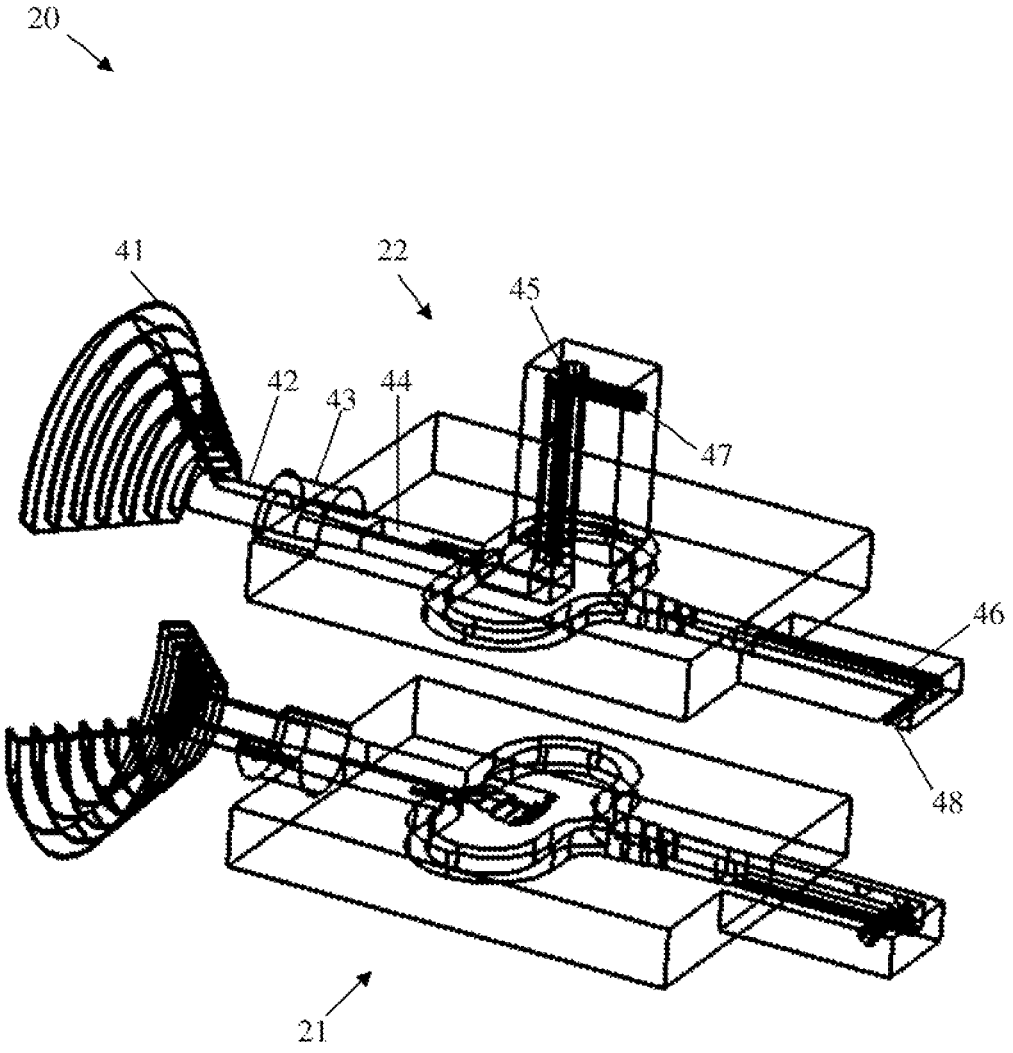
FIG. 5 shows a second exemplary embodiment of the inventive integrated device based on a two piece assembly.

Now, with respect to FIG. 5, a second exemplary embodiment of an inventive integrated device 20 is depicted. The integrated device 20 comprises a horn antenna 41 with an antenna waveguide feed 42, a waveguide transition element 43 comprising a first end connected to the antenna waveguide feed 42 and a second end, and an orthomode transducer comprising a common waveguide 44 connected to the second end of the waveguide transition element 43 and two separate waveguides, especially a first separate waveguide 45 and a second separate waveguide 46.

In this context, the orthomode transducer is adapted to couple at least two orthogonal linear polarized fields into the common waveguide 44 of the orthomode transducer with the aid of the two separate waveguides 45, 46 of the orthomode transducer and/or vice versa, wherein the horn antenna 41 is adapted to support at least two waveguide modes corresponding to the at least two orthogonal linear polarized fields.

As it can further be seen from FIG. 5, the integrated device 20 is manufactured in two separate blocks 21, 22 such that each part of the two piece assembly is constructed as external protrusions and/or and/or holes and/or partial holes.

Furthermore, it is noted that the antenna waveguide feed 42 is a circular antenna waveguide feed, whereas the common waveguide 44 of the orthomode transducer is of square shape.

As a consequence of this, the first end of the waveguide transition element 43 is of circular shape, whereas the second end of the waveguide transition element 43 is of square shape. In other words, in this exemplary case, the wave guide transition element 43 is a circular to square waveguide transition element.

Moreover, according to FIG. 5, each of the two separate waveguides 35, 36 of the orthomode transducer is of rectangular shape.

It is noted that it might be particularly advantageous if alignment pins and threaded holes are provided on the two piece assembly 20 in order to facilitate the assembly.

Whereas said alignment pins and threaded holes are not explicitly shown in FIG. 5, FIG. 5 illustrates that the integrated device 20 further comprises two waveguide to coax interfaces, preferably two rectangular waveguide to coax interfaces, especially a first rectangular waveguide to coax interface 47 and a second rectangular waveguide to coax interface 48.

In this context, each of the two rectangular waveguide to coax interfaces 47, 48 is connected to the respective one of the two separate waveguides 45, 46 of the orthomode transducer.

Preferably, each of the two rectangular waveguide to coax interfaces 47, 48 may be constructed as a separate and/or detachable part.

Furthermore, it is noted that the integrated device 20 may preferably comprise at least one screw connection for connecting the two separate blocks 21, 22.

It is further noted that at least one of the two separate blocks 21, 22 may especially comprise metal, preferably metal comprising a gold plating, more preferably aluminum, most preferably aluminum comprising a gold plating, and/or graphene, preferably a graphene plating.

Figure 6:
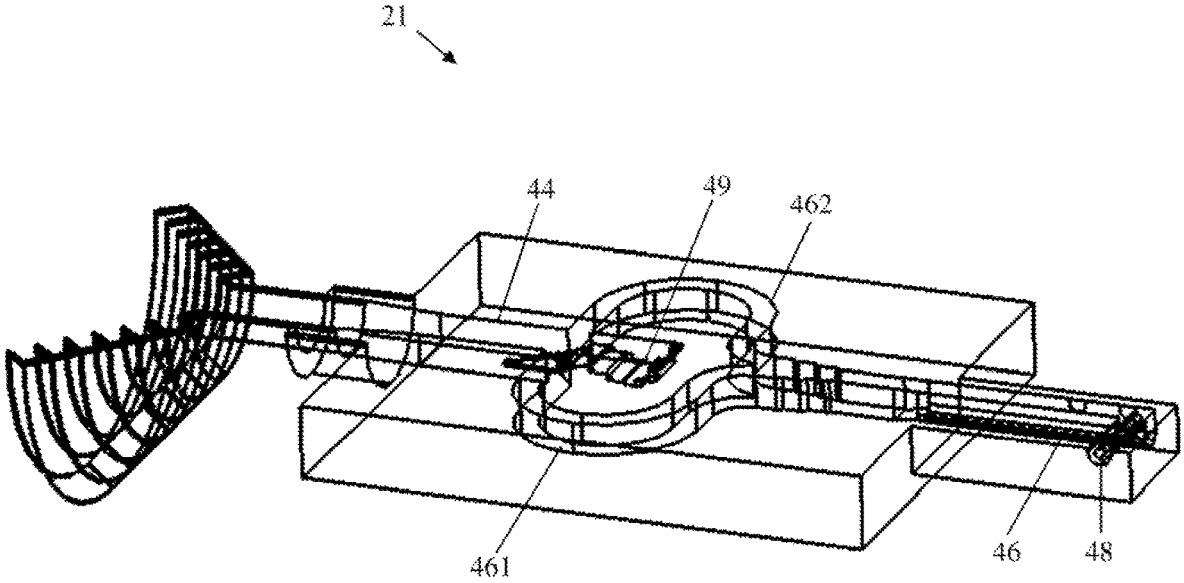
FIG. 6 shows the bottom part of the second exemplary embodiment.

Moreover, FIG. 6 illustrates the bottom part 21 of the second exemplary embodiment according to FIG. 5. As it can be seen, before the waves guided by the first separate waveguide 45 and the second separate waveguide 46 enter the common waveguide 44 of the orthomode transducer, the second separate waveguide 46 is divided into two partial waveguides, especially a first partial waveguide 461 and a second partial waveguide 462.

In this context, it is noted that the respective pathways of the first partial waveguide 461 and the second partial waveguide 462 are symmetric with respect to an axis, especially a longitudinal axis, of the second separate waveguide 46. It might be particularly advantageous if said axis, especially said longitudinal axis, runs through the center of the second separate waveguide 46.

Furthermore, it might be particularly advantageous if at least one, exemplarily each, of the partial waveguides 461, 462 is of a curved shape, a parabolic shape, or an U-shape.

With special respect to the orthomode transducer comprising the common waveguide 44, the first separate waveguide 45, and the second separate waveguide 46, it is noted that the common waveguide 44 and the second separate waveguide 46 are especially comprised, preferably intersected or touched, by the same plane. In addition to this, the first separate waveguide 45 is preferably perpendicularly arranged with respect to the common waveguide 44 and/or the second separate waveguide 46.

Moreover, in accordance with FIG. 6, the region 49, especially being located near the common waveguide 44 and in which the first separate waveguide 45 is arranged, is beveled. Preferably, the respective surface rises with decreasing distance from the common waveguide 44 or from the horn antenna 41, respectively. In addition to this or as an alternative, especially within the common waveguide 44 or within an entry area of the common waveguide 44, the respective surface falls with decreasing distance from the horn antenna 41.

Furthermore, with respect to the bottom part 21 illustrated by FIG. 6, it is noted that said exemplary bottom part 21 comprises a part of the horn antenna 41, a part of the antenna waveguide feed 42, a part of the waveguide transition element 43, a part of the common waveguide 44, a part of the first partial waveguide 461, a part of the second partial waveguide 462, a part of the second separate waveguide 46, and a part of the second rectangular waveguide to coax interface 48.

Figure 7:
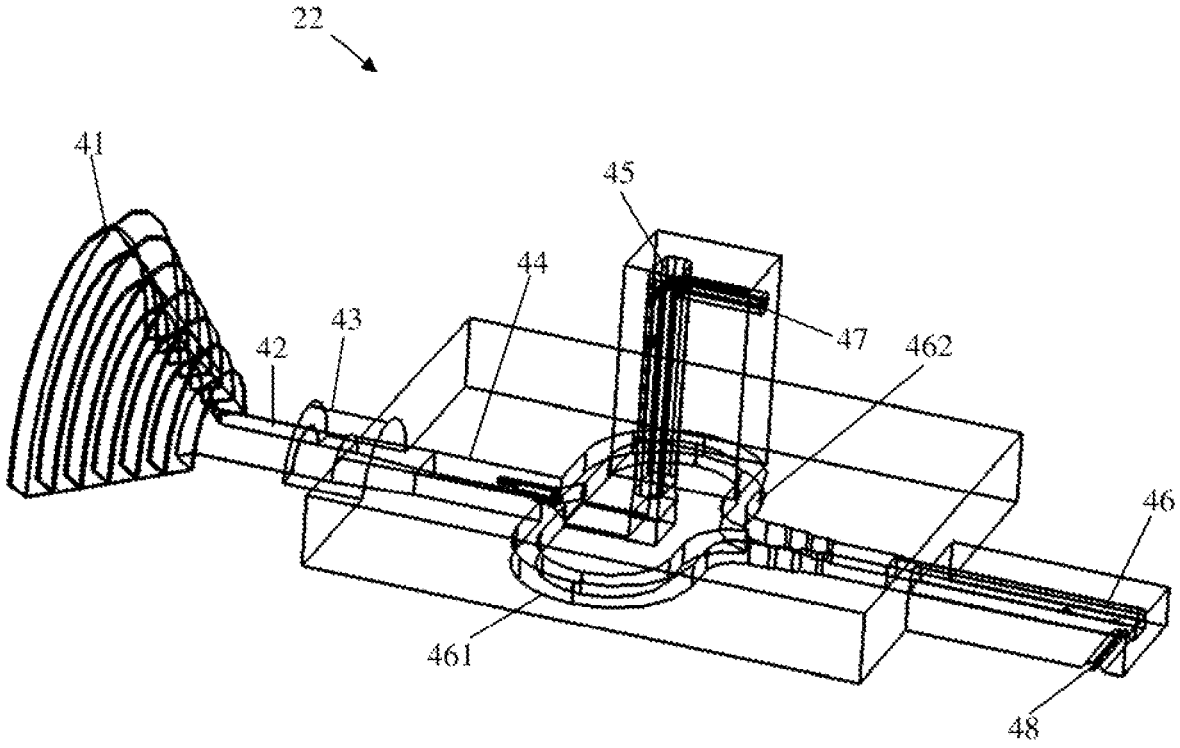
FIG. 7 shows the top part of the second exemplary embodiment.

In addition to this, as illustrated by FIG. 7, the top part 22 of the second embodiment 20 comprises a part of the horn antenna 41, a part of the antenna waveguide feed 42, a part of the waveguide transition element 43, a part of the common waveguide 44, the first separate waveguide 45, a part of the first partial waveguide 461, a part of the second partial waveguide 462, a part of the second separate waveguide 46, the first rectangular waveguide to coax interface 47, and a part of the second rectangular waveguide to coax interface 48.

In this context, it is noted that it might be particularly advantageous if said part is especially a half.

Figure 8:
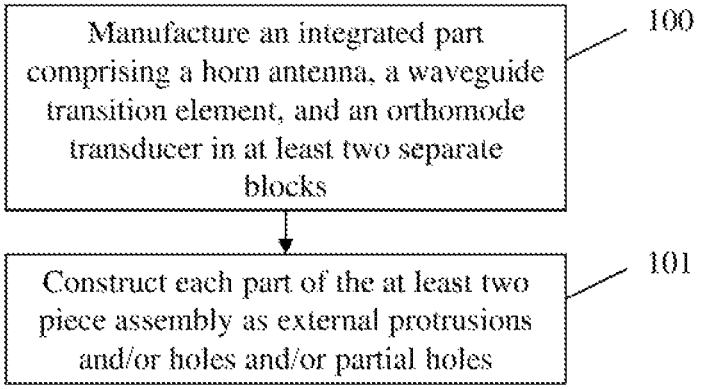
FIG. 8 shows a flow chart of an exemplary embodiment of the second aspect of the invention.

Finally, FIG. 8 shows a flow chart of an exemplary embodiment of the inventive manufacturing method. In a first step 100, an integrated device comprising a horn antenna, a waveguide transition element, and an orthomode transducer is manufactured in at least two separate blocks. Then, in a second step 101, each part of the at least two piece assembly is constructed as external protrusions and/or holes and/or partial holes.

In this context, it might be particularly advantageous if the antenna waveguide feed is manufactured as an elliptical antenna waveguide feed, preferably a circular antenna waveguide feed.

Further advantageously, the first end of the waveguide transition element may especially be of elliptical shape, preferably of circular shape.

In addition to this or as an alternative, the second end of the waveguide transition element may especially be of rectangular shape, preferably of square shape.

Further additionally or alternatively, the common waveguide of the orthomode transducer may especially be of rectangular shape, preferably of square shape.

Furthermore, it is noted that at least one of the at least two separate waveguides of the orthomode transducer may preferably be of rectangular shape.

Moreover, it might be particularly advantageous if the manufacturing method further comprises the step of providing alignment pins and threaded holes on the at least two piece assembly to facilitate the assembly.

In addition to this or as an alternative, the manufacturing method may further comprise the steps of providing at least one waveguide to coax interface, preferably at least one rectangular waveguide to coax interface, for the integrated device, and connecting the at least one waveguide to coax interface, preferably the at least one rectangular waveguide to coax interface, to at least one of the at least two separate waveguides of the orthomode transducer.

In this context, the manufacturing method may further comprise the step of constructing the at least one waveguide to coax interface, preferably the at least one rectangular waveguide to coax interface, as a separate and/or detachable part.

Additionally or alternatively, the manufacturing method may further comprise the step of connecting the at least two separate blocks of the integrated device with the aid of at least one screw connection.

In further addition to this or as a further alternative, at least one of the at least two separate blocks may especially comprise metal, preferably metal comprising a gold plating, more preferably aluminum, most preferably aluminum comprising a gold plating, and/or graphene, preferably a graphene plating.

Furthermore, it is noted that it might be particularly advantageous if the manufacturing method comprises the steps of manufacturing the integrated device in three separate blocks, constructing each part of the three piece assembly as external protrusions and/or partial holes, and milling the external protrusions and/or partial holes without forming enclosed internal cavities and/or holes.

While various embodiments of the present invention have been described above, it should be understood that they have been presented by way of example only, and not limitation. Numerous changes to the disclosed embodiments can be made in accordance with the disclosure herein without departing from the spirit or scope of the invention. For example, a current may be measured instead of a voltage. Thus, the breadth and scope of the present invention should not be limited by any of the above-described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

What is claimed is:

1. An integrated device comprising:

a horn antenna with an antenna waveguide feed;

a waveguide transition element comprising a first end connected to the antenna waveguide feed and a second end;

an orthomode transducer comprising a common waveguide connected to the second end of the waveguide transition element and at least two separate waveguides; and at least one waveguide to coax interface, wherein the at least one waveguide to coax interface is connected to at least one of the at least two separate waveguides of the orthomode transducer, and wherein the at least one waveguide to coax interface is configured as a separate and/or detachable part; and wherein the orthomode transducer is adapted to couple at least two orthogonal linear polarized fields into the common waveguide of the orthomode transducer with the aid of the at least two separate waveguides of the orthomode transducer and/or vice versa.

2. The integrated device according to claim 1, wherein the horn antenna is adapted to support at least two waveguide modes corresponding to the at least two orthogonal linear polarized fields, and/or wherein the integrated device is configured in at least two separate blocks such that each part of the at least two piece assembly is configured as one or more of external protrusions, holes and partial holes.

3. The integrated device according to claim 1, wherein the antenna waveguide feed is one of an elliptical antenna waveguide feed and a circular antenna waveguide feed, and/or wherein the first end of the waveguide transition element is of one of an elliptical shape and a circular shape.

4. The integrated device according to claim 1, wherein the second end of the waveguide transition element is of one of a rectangular shape and a square shape.

5. The integrated device according to claim 1, wherein the common waveguide of the orthomode transducer is of one of a rectangular shape and a square shape.

6. The integrated device according to claim 1, wherein at least one of the at least two separate waveguides of the orthomode transducer is of a rectangular shape.

7. The integrated device according to claim 2, wherein alignment pins and threaded holes are provided on the at least two piece assembly to facilitate the assembly.

8. The integrated device according to claim 2, wherein the integrated device comprises at least one screw connection for connecting the at least two separate blocks.

9. The integrated device according to claim 2, wherein at least one of the at least two separate blocks is composed of a metal material.

10. The integrated device according to claim 9, wherein the metal material comprises one or more of gold plating, aluminum, aluminum comprising a gold plating, graphene and a graphene plating.

11. An integrated device comprising:

a horn antenna with an antenna waveguide feed;

a waveguide transition element comprising a first end connected to the antenna waveguide feed and a second end; and an orthomode transducer comprising a common waveguide connected to the second end of the waveguide transition element and at least two separate waveguides; and wherein the orthomode transducer is adapted to couple at least two orthogonal linear polarized fields into the common waveguide of the orthomode transducer with the aid of the at least two separate waveguides of the orthomode transducer and/or vice versa, and wherein the integrated device is configured in three separate blocks such that each part of the three piece assembly is provided as one or more of external protrusions and partial holes, and wherein the one or more of the external protrusions and partial holes are milled without forming enclosed internal cavities or holes.

12. A manufacturing method for manufacturing an integrated device, comprising a horn antenna, a waveguide transition element and an orthomode transducer, the manufacturing method comprising the steps of:

manufacturing the integrated device in at least three separate blocks;

manufacturing each part of the at least three piece assembly as one or more of external protrusions and partial holes; and milling the one or more of the external protrusions and partial holes without forming enclosed internal cavities or holes.

13. The manufacturing method according to claim 12, wherein the manufacturing method further comprises the step of:

providing alignment pins and threaded holes on the at least three piece assembly to facilitate assembly of the integrated device.

* * * * *